US007753649B2

(12) United States Patent
Micheli

(10) Patent No.: US 7,753,649 B2
(45) Date of Patent: Jul. 13, 2010

(54) METHOD FOR MODIFYING A MULTISTAGE COMPRESSOR

(75) Inventor: Marco Micheli, Wettingen (CH)

(73) Assignee: Alstom Technology Ltd., Baden (CH)

( * ) Notice: Subject to any disclaimer, the term of this patent is extended or adjusted under 35 U.S.C. 154(b) by 193 days.

(21) Appl. No.: 11/775,936

(22) Filed: Jul. 11, 2007

(65) Prior Publication Data

US 2008/0260516 A1 Oct. 23, 2008

Related U.S. Application Data

(63) Continuation of application No. PCT/EP2006/050172, filed on Jan. 12, 2006.

(30) Foreign Application Priority Data

Jan. 14, 2005 (EP) ..... 05100201

(51) Int. Cl.
*F01D 1/02* (2006.01)

(52) U.S. Cl. ..... 415/191; 415/199.5

(58) Field of Classification Search ..... 415/191, 415/199.5, 211.2; 416/243
See application file for complete search history.

(56) References Cited

U.S. PATENT DOCUMENTS 2,705,590 A * 4/1955 Lovesey et al. ..... 415/17
2,990,106 A * 6/1961 Craig ..... 415/194
2,999,668 A * 9/1961 Howald et al. ..... 416/97 R
3,428,244 A 2/1969 Palmer
4,252,498 A * 2/1981 Radcliffe et al. ..... 415/26

FOREIGN PATENT DOCUMENTS

GB 1080026 A 8/1967

* cited by examiner

*Primary Examiner*—Edward Look
*Assistant Examiner*—Ryan H Ellis
(74) *Attorney, Agent, or Firm*—Volpe and Koenig, P.C.

(57) ABSTRACT

A method for modifying a multistage compressor (101) involves exchanging the rotor blades of the first compressor rotor blade row (LA1) for modified rotor blades which have an identical blade leaf profile (121) to the original rotor blades and the blade angle ($B'_{11}$) of which is different from the blade angle ($B'_{10}$) of the original rotor blades. Furthermore, the blades of at least one further blade row (LAN, LEN) arranged downstream of the second compressor stage are exchanged for modified blades which have an identical blade leaf profile (125, 126) to the original blades and the blade angle ($B'_{N1}$, $B''_{N1}$) of which is different from the blade angle ($B'_{NO}$, $B''_{NO}$) of the original blades. The method makes it possible to increase the mass flow of a compressor and essentially maintain the stability reserve against stall.

16 Claims, 2 Drawing Sheets

METHOD FOR MODIFYING A MULTISTAGE COMPRESSOR

CROSS REFERENCE TO RELATED APPLICATIONS

This application is a continuation of International Application No. PCT/EP2006/050172, filed Jan. 12, 2006, which is incorporated by reference as if fully set forth.

FIELD OF INVENTION

The invention relates to a method for modifying a multistage compressor. It further relates to a compressor modified according to the specified method and to a gas turbo group which comprises a compressor thus modified.

BACKGROUND

A modification of turbocompressors may take place in that the blade angle of blade rows is varied while the profile of the blade leaves remains constant. The blade angle is in this case normally defined as the angle which the chord of the profile forms with the circumferential direction of the compressor. By virtue of this possibility of varying the geometry of a blade cascade, for example, the mass flow can be increased without a redesign of the blade leaf being required. This is implemented, for example, in the case of adjustable compressor guide blade rows and, in particular, in the case of an adjustable entry guide blade row of a compressor. However, the implementation of a plurality of adjustable guide blade rows is comparatively complicated.

SUMMARY

The invention relates to a method for increasing the absorption capacity in a multistage compressor. The compressor including rotor blades of a first compressor rotor blade row with a defined blade leaf profile. The rotor blades having a predetermined blade angle in a flow direction. Blades of at least one further blade row are arranged downstream of a second compressor stage having a defined blade leaf profile and, in the flow direction, a predetermined blade angle. The compressor rotor blade row and the at least one further blade row are arranged downstream of the second stage, include unchanged blade leaf profiles, and operate with a different blade angle, as compared with the predetermined blade angles. The blade angles of the at least one further blade row are selected as a function of the blade angle, modified for a greater absorption capacity, of the first compressor rotor blade row.

The invention also relates to a device for increasing an absorption capacity in a multistage compressor. The compressor including rotor blades of a first compressor rotor blade row with a defined blade leaf profile. The rotor blades having a predetermined blade angle in the flow direction. The blades of at least one further blade row arranged downstream of the compressor stage having a defined blade leaf profile and, in the flow direction, a predetermined blade angle. The compressor rotor blade row and at least one further blade row are arranged downstream of the second compressor stage and have unchanged blade leaf profiles and a different blade angle, as compared with the predetermined blade angles. The blade angles of the at least one further blade row are selected as a function of the blade angle modified for a greater absorption capacity, of the first compressor rotor blade row.

The invention further relates to a device for increasing an absorption capacity in a multistage compressor. The compressor including rotor blades of a first compressor rotor blade row with a defined blade leaf profile. The rotor blades have a predetermined blade angle in the flow direction, and blades of at least one further blade row are arranged downstream of a second compressor stage and have a defined blade leaf profile and, in the flow direction, a predetermined blade angle. The compressor rotor blade row and the at least one further blade row are arranged downstream of the second compressor stage and have, unchanged blade leaf profiles and a different blade angle, as compared with the predetermined blade angles. The blade angles of the at least one further blade row are selected as a function of the blade angle, modified for a greater absorption capacity, of the first compressor rotor blade row.

Further advantageous and expedient developments of the invention become clear to a person skilled in the art in light of the subclaims and of the exemplary embodiment illustrated below.

BRIEF DESCRIPTION OF THE DRAWINGS

The method specified above is explained in more detail below with reference to an exemplary embodiment illustrated in the drawing in which, in particular.

Figure 1:
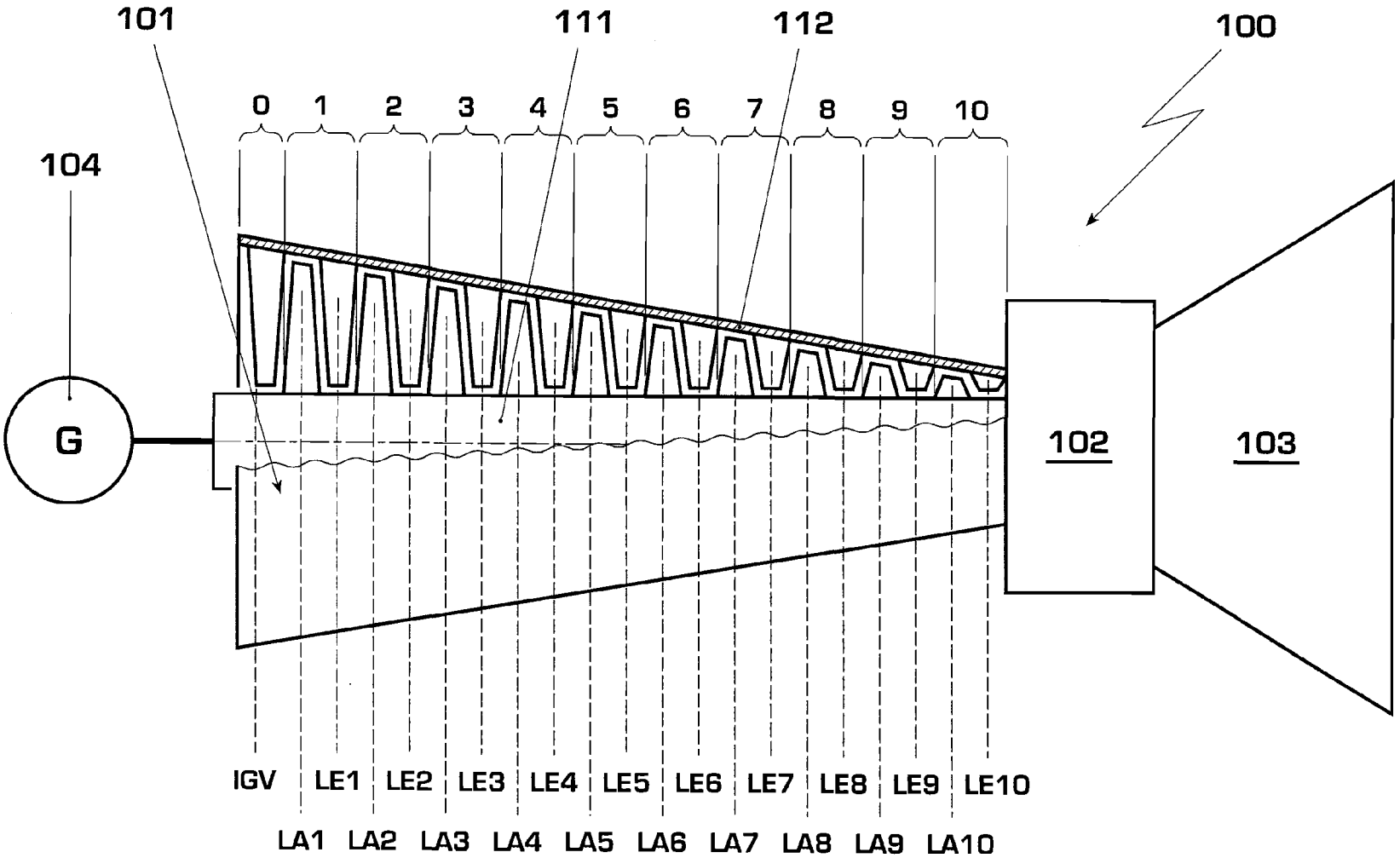
FIG. 1 shows a gas turbo group.

Particulars which are not essential for understanding the invention have been omitted. The exemplary embodiment and the drawing are to serve for a better understanding of the method described above and are not to be cited in order to restrict the invention characterized in the claims.

DETAILED DESCRIPTION OF THE PREFERRED EMBODIMENTS

Introduction to the Embodiments

According to one aspect of the invention, a method for modifying a multistage compressor by the staggering of blades, that is, the varying of the blade angle, is set forth where the blade leaf profile is maintained. According to a more specific aspect of the invention, this possibility is to be specified without adjustable blade rows being used. According to another aspect of the invention, the mass flow of the compressor is increased, in one exemplary embodiment, by up to six percent, as compared with a compressor before modification. In a more particular embodiment, the increase in the mass flow is to be achieved without the flow stability in the compressor being reduced or without giving rise to flow blockages in the blade ducts on account of the increased mass flow.

The method involves exchanging the rotor blades of the first compressor blade row for modified rotor blades which have an identical blade leaf profile to and a different blade angle than the rotor blades originally installed. The absorption capacity of the first compressor rotor blade row can thereby be increased and, in particular, in conjunction with an adjustable entry guide blade row, the compressor mass flow can be increased. Furthermore, a potentially impaired flow stability accompanying the modified geometry of the blade cascade is counteracted in that the blade angle of at least one blade row arranged further downstream and, in particular, downstream of the second compressor stage is modified. For this purpose, the blades of the at least one further blade row are exchanged for modified blades which have an identical blade leaf profile to the original blades and the blade angle of which is different from that of the original blades. In one embodiment of the invention, the variation of the blade angle in the further blade row is codirectional to the variation of the blade angle in the first compressor rotor blade row, that is to say, when the blade angle of the first compressor rotor blade row is increased, the blade angle of the further blade row is also increased, and, when the blade angle of the first compressor rotor blade row is reduced, the blade angle of the further blade row is also reduced. In one embodiment of the invention, the blade geometry of the guide blade row of the first compressor stage is maintained, unchanged, that is, neither the blade leaf profile nor the blade angle are modified.

The term "compressor stage" is to be understood in this context as meaning the arrangement of a compressor rotor blade row and of a compressor guide blade row following downstream. This is to be understood in contrast to a turbine stage which comprises a guide blade row with a rotor blade row arranged downstream of it. A rotor blade row, or moving blade row, comprises a blade ring or blade cascade which comprises a plurality of rotor blades. These are also designated as rotor components, for example rotor blading, a rotor blade ring or rotor blade cascade or the like. A guide blade row comprises a blade ring or a blade cascade which comprises a plurality of guide blades. These are also designated as stator components, for example stator blading, a stator blade ring or stator blade cascade and the like.

One development of the method specified here involves exchanging the rotor blades of the second compressor rotor blade row for modified rotor blades which have an identical blade leaf profile to the original rotor blades and a blade angle which is different from that of the original rotor blades. One embodiment of this development involves maintaining, unchanged, the blade geometry of the guide blade row of the second compressor stage.

Developments of the method described here involve, in at least one compressor stage arranged downstream of the second compressor stage, exchanging both the blades of the rotor blade row and the blades of a guide blade row for modified blades which have an identical blade leaf profile to the original blades and a blade angle which is different from that of the original blades, and/or exchanging the blades of at least one blade row of each compressor stage arranged downstream of the second compressor stage for modified blades which have an identical blade leaf profile to the original blades and a blade angle which is different from that of the original blades.

In one embodiment of the method, the blade angles in the blade rows, the blades of which are exchanged for modified blades, are adapted to one another in such a way that the relative enthalpy build-up, in relation to the total enthalpy build-up in the compressor, in the individual compressor stages and/or in the individual blade rows is kept essentially constant, as compared with the unmodified compressor. It is consequently possible to vary the mass flow of the compressor and at the same time to maintain, essentially unchanged, the stability reserve against stall.

An increase in the blade angle, which is defined as the angle which the chord of the blade leaf profile forms with the circumferential direction of the compressor, results generally in an increase in the mass flow. An application of the method described here, in which originally installed blades are exchanged for modified blades in which the chords of the blade leaf profiles are oriented in the direction of the compressor axis to a greater extent than in the case of the originally installed blades, consequently results in an application of the method for increasing the compressor mass flow. By means of an exemplary embodiment of the method, an increase in the compressor mass flow of up to six percent can be achieved without the stability reserve of the compressor being appreciably changed.

The refinements of the method which are described above may be combined with one another.

The invention further comprises a compressor which is modified by means of the method described above. Such a compressor comprises, in particular, at least two axial compressor stages and, in a more specific embodiment, is a purely axial multistage compressor. Purely axial multistage turbocompressors are used, for example, as compressors of gas turbo groups; the invention also to that extent comprises a gas turbo group which has a compressor modified by means of a method described above.

DETAILED DESCRIPTION

FIG. 1 illustrates a gas turbo group 100. This comprises a multistage axial turbocompressor 101, a combustion chamber 102 and a turbine 103. The shaft 111 of the gas turbo group is drivingly-connected to a generator 104. The compressor 101 comprises a casing, in which the static components of the compressor are arranged, and the shaft 111, on which the rotor components are arranged. The compressor, illustrated by way of example and in simplified form, comprises an entry guide blade row IGV, which may be equipped with adjustable guide blades, and ten compressor stages 1 to 10. The number of compressor stages does not in this case constitute a restriction; the turbocompressors of modern gas turbo groups conventionally have a higher number of stages of, for example, 10 to 22. However, to illustrate the invention, it is sufficient and clearer to illustrate ten compressor stages. The throughflow direction of the compressor is from left to right in the drawing. The first compressor stage comprises a rotor blade row LA1 arranged on the shaft and a guide blade row LE1 arranged downstream of the latter in the casing. All the further compressor stages likewise in each case comprise a rotor blade row with a guide blade row arranged downstream of the latter. In a way known per se, each blade row comprises a plurality of blades, each of which has a blade root and a blade leaf likewise in a way known per se.

Figure 2:
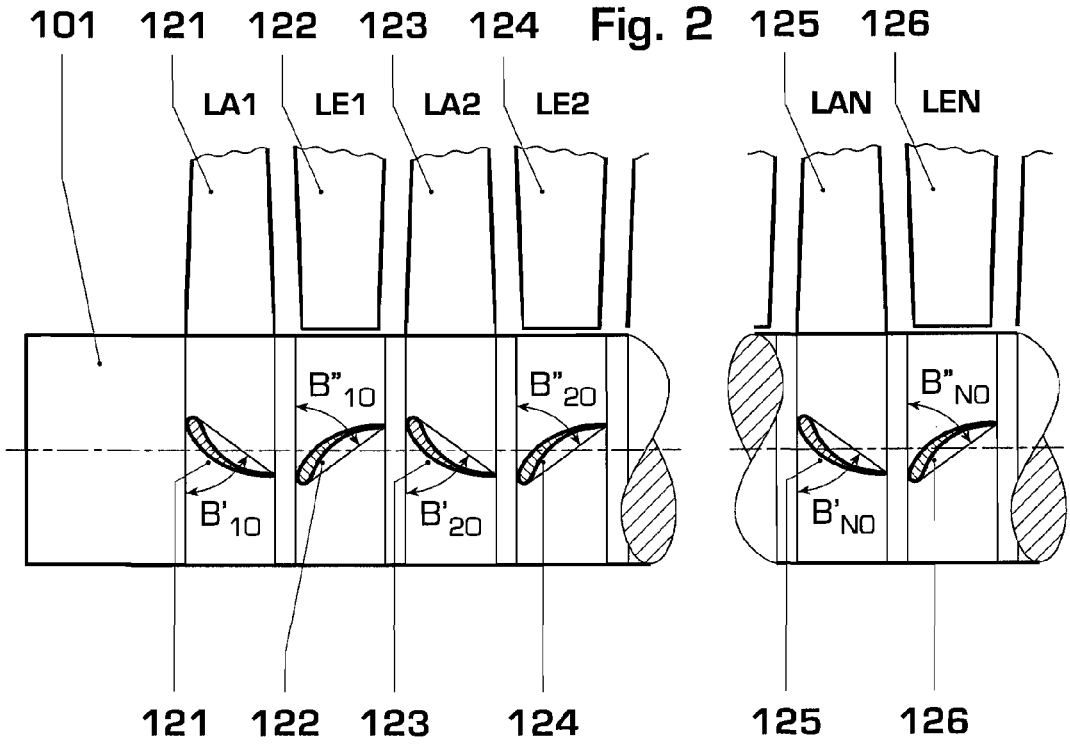
FIG. 2 shows details of a multistage axial compressor.

FIG. 2 shows details of an exemplary compressor, such as is used, for example, in the gas turbo group from FIG. 1, in the original state, that is to say before modification by means of the specified method. The first two compressor stages are illustrated, comprising rotor blade row LA1 and guide blade row LE1 and also rotor blade row LA2 and guide blade row LE2. Also illustrated is an arbitrary compressor stage N arranged downstream of the second compressor stage and having rotor blade 124, 125 and 126. In a view radially from outside, the blade leaf profiles can be seen, and also the blade angle which is defined as the angle which the chord of the blade leaf profile forms with the circumferential direction of the compressor. The blade angle of the blades 121 of the first rotor blade row LA1 is designated by $B'_{10}$. The blade angle of the blades 122 of the first guide blade row LE1 is designated by $B''_{10}$. The blade angle of the blades 123 of the second rotor blade row LA2 is designed by $B'_{20}$. The blade angle of the blades 124 of the second guide blade row LE2 is designed by $B''_{20}$. The blade angle of the blades 125 of the rotor blade row LAN is designed by $B'_{NO}$. The blade angle of the blades 126 of the guide blade row LEN is designated by $B''_{NO}$.

Figure 3:
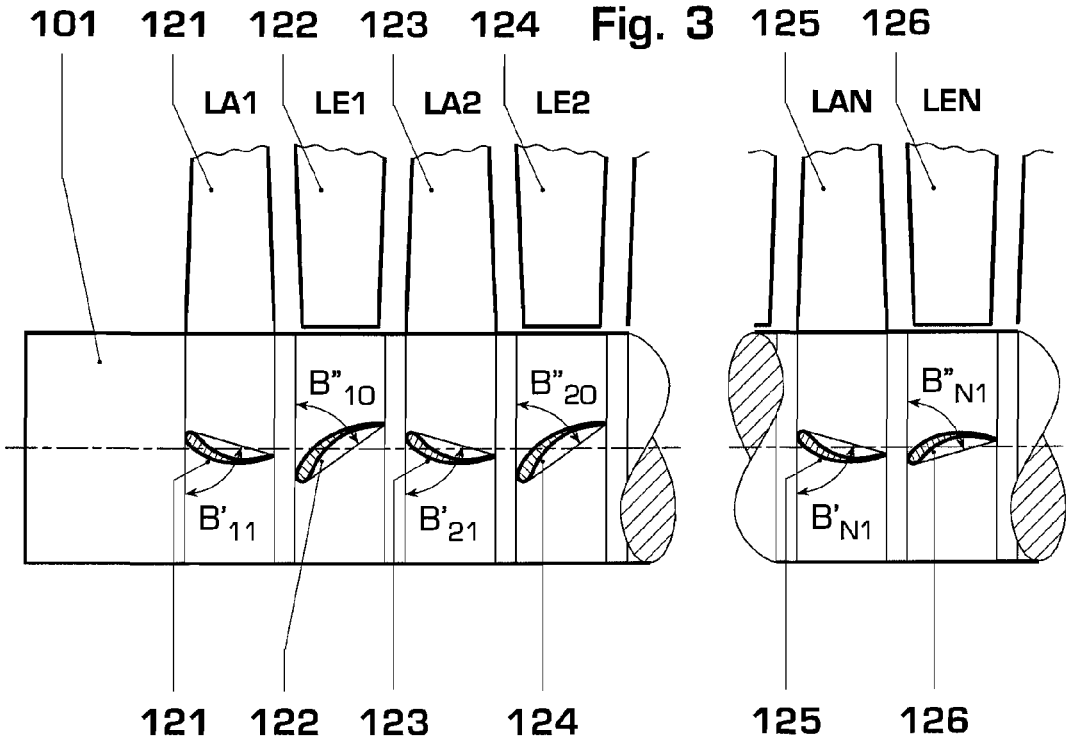
FIG. 3 shows details of a modified multistage axial compressor.

FIG. 3 illustrates the compressor from FIG. 2 which has been modified by means of the method described. The blade leaf profiles of the blades in the blade rows illustrated are identical. The blade angle in the guide blade rows LE1 of the first compressor stage and LE2 of the second compressor stage has likewise been maintained. By contrast, the blade angle in the first rotor blade row LA1 has been increased from $B'_{10}$ to $B'_{11}$. The blade angle of the second rotor blade row LA2 has been increased from $B'_{20}$ to $B'_{21}$. The profile chords in these two rotor blade rows, then, are oriented to a greater extent in the direction of the axis of the compressor. The degree of blocking of the respective blade cascade is consequently reduced, thus resulting in an increase in the compressor mass flow. In the rotor blade row LAN and the guide blade row LEN, the blade angles are likewise increased from $B'_{NO}$ and $B''_{NO}$ to $B'_{N1}$ and $B''_{N1}$; the blade leaf profiles are in each case maintained identically. This modification may also be carried out in other blade rows of the compressor which are not illustrated. It is in this case not necessary always to modify the blade angles of the rotor blade row and of the guide blade row of a stage; likewise, in a stage, only the blade angle either of the rotor blade row or of the guide blade row may be modified. The modification of blade rows arranged downstream of the second compressor stage has the effect that, on the one hand, no flow blocking occurs in these blade rows on account of the increased mass flow and, on the other hand, the enthalpy build-up of the compressor is not displaced superproportionally into the first and the second rotor blade row, which would otherwise reduce the stability reserve against stall in the blade cascades of the first and of the second rotor blade row.

Although not mentioned explicitly, it is obvious to a person skilled in the art that the illustrations given above can be applied in a similar way to compressor bladings in which the blade leaf profiles are variable over the blade height and in particular also for twisted blades familiar to a person skilled in the art; the illustrations in FIGS. 2 and 3 then relate to a circumferential section.

LIST OF REFERENCE SYMBOLS

| List of reference symbols: | |
|---|---|
| 0 | Entry guide blade row |
| 1 | First compressor stage |
| 2 | Second compressor stage |
| 3 | Third compressor stage |
| 4 | Fourth compressor stage |
| 5 | Fifth compressor stage |
| 6 | Sixth compressor stage |
| 7 | Seventh compressor stage |
| 8 | Eighth compressor stage |
| 9 | Ninth compressor stage |
| 10 | Tenth compressor stage |
| 100 | Gas turbo group |
| 101 | Compressor |
| 102 | Combustion chamber |
| 103 | Turbine |
| 104 | Generator |
| 111 | Shaft |
| 112 | Casing |
| 121 | Blade leaf of the first rotor blade row |
| 122 | Blade leaf of the first guide blade row |
| 123 | Blade leaf of the second rotor blade row |
| 124 | Blade leaf of the second guide blade row |
| 125 | Blade leaf of the rotor blade row N |
| 126 | Blade leaf of the guide blade row N |
| IGV | Entry guide blade row |
| LA1 | Rotor blade row of the first compressor stage |
| LE1 | Guide blade row of the first compressor stage |
| LA2 | Rotor blade row of the second compressor stage |
| LE2 | Guide blade row of the second compressor stage |

-continued

| List of reference symbols: | |
|---|---|
| LA3 | Rotor blade row of the third compressor stage |
| LE3 | Guide blade row of the third compressor stage |
| LA4 | Rotor blade row of the fourth compressor stage |
| LE4 | Guide blade row of the fourth compressor stage |
| LA5 | Rotor blade row of the fifth compressor stage |
| LE5 | Guide blade row of the fifth compressor stage |
| LA6 | Rotor blade row of the sixth compressor stage |
| LE6 | Guide blade row of the sixth compressor stage |
| LA7 | Rotor blade row of the seventh compressor stage |
| LE7 | Guide blade row of the seventh compressor stage |
| LA8 | Rotor blade row of the eighth compressor stage |
| LE8 | Guide blade row of the eighth compressor stage |
| LA9 | Rotor blade row of the ninth compressor stage |
| LE9 | Guide blade row of the ninth compressor stage |
| LA10 | Rotor blade row of the tenth compressor stage |
| LE10 | Guide blade row of the tenth compressor stage |
| LAN | Rotor blade row of the compressor stage N |
| LEN | Guide blade row of the compressor stage N |
| $B'_{10}$ | Original blade angle in the first rotor blade row |
| $B'_{11}$ | Modified blade angle in the first rotor blade row |
| $B''_{10}$ | Original blade angle in the first guide blade row |
| $B'_{20}$ | Original blade angle in the second rotor blade row |
| $B'_{21}$ | Modified blade angle in the second rotor blade row |
| $B''_{20}$ | Original blade angle in the second guide blade row |
| $B'_{NO}$ | Original blade angle in the rotor blade row of stage N |
| $B'_{N1}$ | Modified blade angle in the rotor blade row of stage N |
| $B''_{NO}$ | Original blade angle in the guide blade row of stage N |
| $B''_{N1}$ | Modified blade angle in the guide blade row of stage N |

What is claimed is:

1. A method for increasing the absorption capacity in a multistage compressor, the compressor comprising rotor blades of a first compressor rotor blade row with a defined blade leaf profile, the rotor blades having a fixed blade angle in a flow direction, and blades of at least one further blade row arranged downstream of a second compressor stage having a defined blade leaf profile and, in the flow direction, a fixed blade angle, substantially identical to the blade angle of the first compressor rotor blade row, the compressor rotor blade row and at the least one further blade row arranged downstream of the second stage, are exchanged with different blade rows that include unchanged blade leaf profiles, and operate with a different blade angle, as compared with the fixed blade angles, and the blade angles of the at least one further blade row are selected as a function of the blade angle, modified for a greater absorption capacity, of the first compressor rotor blade row.

2. The method as claimed in claim 1, wherein the blade geometry of the guide blade row of the first compressor stage is maintained unchanged.

3. The method as claimed in claim 1, wherein the rotor blades of the second compressor rotor blade row are exchanged for modified rotor blades which have an identical blade leaf profile to the original rotor blades and the blade angle of which is different from the blade angle of the original rotor blades.

4. The method as claimed in claim 3, wherein the blade geometry of the guide blade row of the second compressor stage is maintained unchanged.

5. The method as claimed in claim 1, wherein the further blade row is a rotor blade row.

6. The method as claimed in claim 1, wherein the further blade row is a guide blade row.

7. The method as claimed in claim 1, wherein, in at least one compressor stage arranged downstream of the second compressor stage, both the blades of the rotor blade row and the blades of the guide blade row are exchanged for modified blades which have an identical blade leaf profile to the original blades and the blade angle of which is different from that of the original blades.

8. The method as claimed in claim 1, wherein the blades of at least one of the blade rows of each compressor stage arranged downstream of the second compressor stage are exchanged for modified blades which have an identical blade leaf profile to the original blades and the blade angle of which is different from that of the original blades.

9. The method as claimed in claim 1, wherein the blade angles in the blade rows, the blades of which are exchanged for modified blades, are coordinated with one another in such a way that a relative enthalpy build-up in the individual compressor stages is kept essentially constant.

10. The method as claimed in claim 1, wherein the blade angle of the modified blades is greater than the blade angle of the original blades, in such a way that chords of the blade leaf profiles of the modified blades are oriented to a greater extent in a direction of the compressor axis as a function of the increased mass flow.

11. The method as claimed in claim 1, wherein the compressor mass flow is increased.

12. A multistage compressor comprising, rotor blades of a first compressor rotor blade row with a defined blade leaf profile, the rotor blades having a fixed blade angle in a flow direction, and blades of at least one further blade row arranged downstream of a second compressor stage having a defined blade leaf profile and, in the flow direction, a fixed blade angle, substantially identical to the blade angle of the first compressor rotor blade row, the compressor rotor blade row and the at least one further blade row, arranged downstream of the second stage, wherein replacement blade rows include unchanged blade leaf profiles, and operate with a different blade angle, as compared with the fixed blade angles, and the blade angles of the at least one further blade row are selected as a function of the blade angle, modified for a greater absorption capacity, of the first compressor rotor blade row.

13. The compressor as claimed in claim 12, comprising at least three axial compressor stages.

14. The compressor as claimed in claim 13, wherein the compressor is a purely axial multistage compressor.

15. A gas turbo group, comprising a compressor as claimed in claim 12.

16. A device for increasing an absorption capacity in a multistage compressor, the compressor comprising rotor blades of a first compressor rotor blade row with a defined blade leaf profile, the rotor blades having a fixed blade angle in the flow direction, and blades of at least one further blade row arranged downstream of a second compressor stage having a defined blade leaf profile and, in the flow direction, a fixed blade angle, substantially identical to the blade angle of the first compressor rotor blade row, the compressor rotor blade row and the at least one further blade row are arranged downstream of the second compressor stage, the device comprising replacement blade rows for the first compressor rotor blade row and the at least one further blade row, the replacement blade rows have replacement blades with unchanged blade leaf profiles and a different blade angle, as compared with the fixed blade angles, and the blade angles of the replacement blades of the at least one further blade row are selected as a function of the blade angle, modified for a greater absorption capacity, of the replacement blades of the first compressor rotor blade row.

* * * * *